US005640719A

United States Patent [19]

Ritchie

[11] Patent Number: 5,640,719

[45] Date of Patent: Jun. 24, 1997

[54] HITTER'S TRAINING VEST

[76] Inventor: Gregory Ritchie, Rte. 1, Box 933, Mineral, Va. 23117

[21] Appl. No.: 509,675

[22] Filed: Jul. 31, 1995

[51] Int. Cl.[6] ..... A41D 1/04; A41D 13/00

[52] U.S. Cl. ..... 2/102; 2/465; 473/458

[58] Field of Search ..... 2/2, 268, 102, 2/455, 456, 465; 434/247, 249, 252; 273/26 C, 26 R, 29 A

[56] References Cited

U.S. PATENT DOCUMENTS

| | | | |
|---|---|---|---|
| 2,990,549 | 4/1961 | Doughty | 2/2 |
| 4,373,211 | 2/1983 | Goudreau et al. | 2/2 |
| 4,514,862 | 5/1985 | A'Costa | 2/268 |
| 5,375,836 | 12/1994 | Kiser | 273/26 C |

OTHER PUBLICATIONS

Product advertisement from Markworth Sporting Goods Company Catalog, pp. 23, 53 and 55, 1995.

Product advertisement from Pro–One Catalog, "In the Winners' Circles" Athletic & Physical Education Equipment, p. 8, 1993.

Product advertisement from 1995 Baseball Equipment Handbook, pp. 49–53.

*Primary Examiner*—Paul C. Lewis

*Attorney, Agent, or Firm*—Fish & Richardson P.C.

[57] ABSTRACT

A baseball training vest is disclosed for use in training baseball hitters to swing a baseball bat without dropping the trailing arm so far as to cause a poor swing. The vest includes a resilient pad formed to fit under the batter's trailing arm and includes a harness for adjustably securing the pad to the batter.

A method of training a baseball batter in which the batter uses an arm guide to restrict the downward range of motion during batting practice is also disclosed.

2 Claims, 2 Drawing Sheets

HITTER'S TRAINING VEST

BACKGROUND OF THE INVENTION

The instant invention is the subject matter of Disclosure Document No.: 350,354, filed in the U.S. Patent and Trademark Office on Mar. 17, 1994. It is respectfully requested that the disclosure document be retained beyond the two-year period so that it may be relied upon as evidence of conception of the invention during the prosecution phase of this application, should the need arise.

The present invention relates generally to the field of sports training devices and more specifically to a baseball hitter's training device.

One problem that a baseball hitter attempts to overcome in training is called "chicken winging". This occurs when the batter drops his or her trailing arm towards the torso or rib cage causing the palm of the top hand to turn upward with the bat knob prematurely. Pop fly balls are the undesirable result of chicken-winging.

Another symptom of chicken winging is the elevation of the leading shoulder or arm. One device intended to prevent chicken-winging attempts to restrict upward movement of the leading arm using a harness which ties the leading arm to the torso. Because such devices attack a secondary symptom, elevation of the leading arm, they are not effective to prevent chicken winging, which is caused by dropping the trailing arm.

SUMMARY OF THE INVENTION

A training vest in accordance with the present invention includes a harness and a resilient pad. The harness secures the resilient pad in place on the subject. The resilient pad includes a top edge which fits under the subject's predominant arm and which discourages the subject from dropping the predominant arm while swinging a baseball bat.

A method of training hitter's in accordance with the present invention includes placing an arm guide on the hitter. The arm guide is adjusted to limit the downward range of motion of the hitter's trailing arm. The hitter practices swinging a bat using the arm guide.

Other features and advantages of the present invention will become readily apparent to those of ordinary skill in the art by reference to the following Detailed Description and accompanying drawings.

BRIEF DESCRIPTION OF THE DRAWINGS

A better understanding of the invention may be had from a consideration of the following Detailed Description, taken in conjunction with the accompanying drawings in which.

DETAILED DESCRIPTION

One aspect of the present invention maintains the space between the trailing elbow and the rib cage thus ensuring that the top hand remains firm throughout the swing. A baseball hitter's training vest in accordance with the present invention discourages the batter from dropping the trailing arm toward the rib cage. This in turn discourages dipping of the trailing shoulder as well as the head and eyes.

Figure 1:
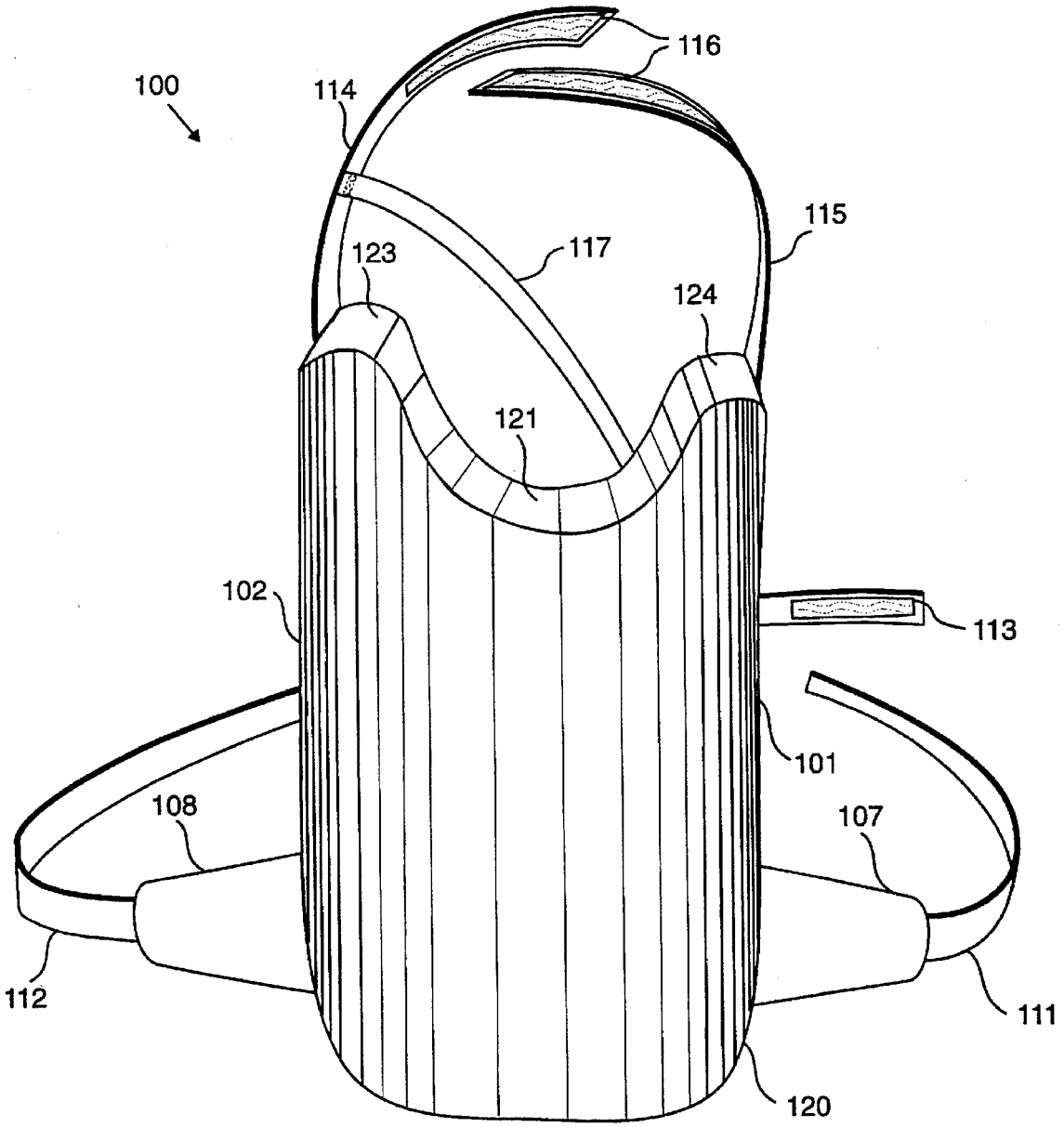
FIG. 1 is a perspective view of the front of a baseball hitter's training vest.
Figure 2:
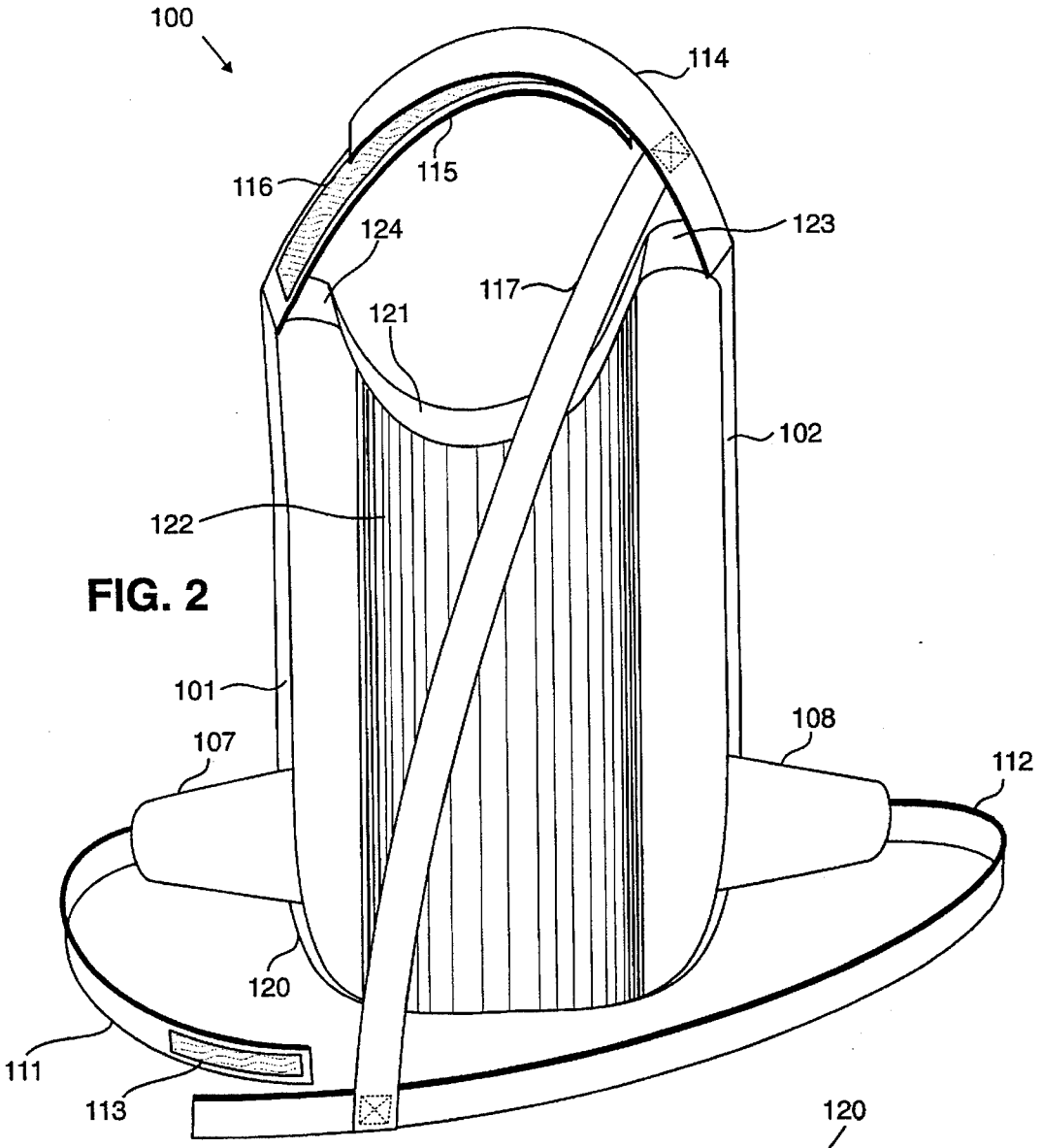
FIG. 2 is a perspective view of the back of a baseball hitter's training vest.

Referring now to FIG. 1, a baseball hitter's training vest 100 in accordance with one embodiment of the present invention is shown in a perspective front view. The vest 100 comprises a pad 120 and a harness 110. The pad is shaped to comfortably fit the batter and at the same time discourage or prevent the batter from dropping the trailing arm. Accordingly, the pad 120 has a contoured top portion 121 which fits under the batter's trailing arm (armpit) i.e., the right arm (armpit) of a right handed batter. For comfort, the top front portion 124 which faces the front of the trailing arm of the contour 121 is slightly lower than the top rear portion 123 which faces the back of the trailing arm. Pad 120 is shaped to fit on the side of the batter's torso from underneath the arm to about the waist. Referring to FIG. 2, reveals that an inside contour 122 may be provided on the inside of pad 120. Contour 122 faces the side of the batter's torso making the pad more form fitting to the batter's body, in particular to the side of the rib cage. The pad 120 may be constructed of a resilient foam core and a leather cover. Preferably, the foam core is between 1 to 3 inches thick and sculpted to fit the rib cage. Any dense foam such as upholstery foam may be used. Although leather is preferred for its well known properties, any other soft and durable material that provides a non-abrasive surface may be used for the pad covering.

Figure 3:
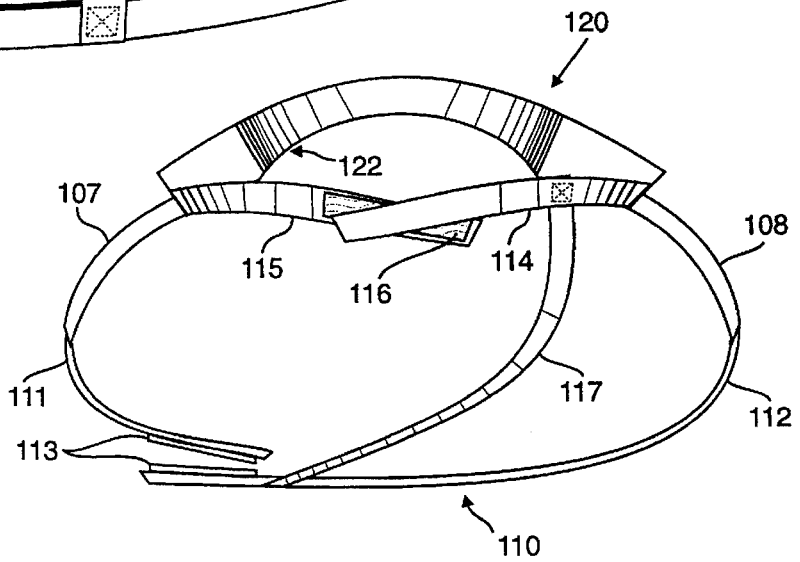
FIG. 3 is a perspective view of the top of a baseball hitter's training vest.

The harness 110 secures pad 120 in place on the batter thus preventing it from shifting positions during the swing. Referring now to FIG. 2 and FIG. 3, the harness 110 includes a two piece shoulder strap 114 and 115, a two piece waist strap 111 and 112, and a cross strap 117 which is attached to the shoulder strap 114 and waist strap 112. Each section of the shoulder strap 114 and 115 and waist strap 111 and 112 is fitted with mating hook and loop fasteners such as those commonly available under the Velcro trademark and thus may be adjusted to achieve a snug but comfortable fit to the batter's torso. The mating fasteners are schematically represented as regions 113 and 116 on waist straps 111 and 112 and shoulder straps 114 and 115, respectively. All of the straps 111, 112, 114, 115, and 117 can be constructed of 1 inchwide belting. Alternatively, the hook and loop fasteners can be replaced with other adjustable fasteners such as the buckles commonly used on luggage straps. Yet another possibility is the use of leather straps with prepunched holes and common belt buckles.

Shoulder straps 114 and 115 are respectively attached to pad 120 at the top of the trailing edge 102 and leading edge 101 of pad 120. Waist belts 111 and 112 are respectively attached to the leading 101 and trailing 102 edges of pad 120 using two leather tension spreading extensions, 107 and 108. One configuration for the extensions has 6 inch wide sections attached to the leather pad covering at the leading and trailing edges and tapers down to a size just larger than the width of the waist straps 111 and 112. The cross strap 117 keeps the shoulder strap from sliding off of the shoulder when in use. Although shown as fixed length, the cross strap 117 may also be made adjustable to obtain the best fit.

In use, the vest is snugly secured to the batter with the contoured top edge 121 up against the pit of the trailing arm and the inside counter 122 against the side of the rib cage. To do this, shoulder straps 114 and 115 are first snugly fastened over the batter's trailing shoulder to obtain a snug fit between the underarm and the contoured top edge 121. Next, the waist straps 111 and 112 are snugly fastened around the batter's waist to comfortably secure the vest to the batter. The vest 100 will deter downward movement of the trailing arm during batting practice when adjusted in this way. The vest may be used in every swing training situation including dry swings, tee work, and soft toss training drills and also in live hitting situations. By training with the vest 100, a baseball hitter may develop his or her muscle memory by repeating proper swings and thus train to avoid chicken-winging.

From the foregoing description it will be apparent that an improved swing training device and method have been described. While a preferred embodiment and other embodiments have been described, it will be appreciated that variations and modifications in the herein described batter's training vest, within the scope of the invention will be apparent to those skilled in the art. Accordingly, the foregoing description should be taken as illustrative and not in a limiting sense.

I claim:

1. A method of training a baseball batter using a training vest having an arm guide having a boundary for guiding the batter's arm through a predetermined range of motion and for impairing movement of the batter's arm toward the batter's torso and a harness attached to said arm guide for securing said arm guide in place relative to the torso, comprising the steps of:

placing said training vest on said batter;

adjusting said arm guide and said harness such that the range of motion of the trailing arm of said batter is deterred from dropping toward the torso of said batter; and having the batter swing a baseball bat using said arm guide.

2. A method of training a baseball batter using a baseball batter's training vest for maintaining a predetermined space between the trailing arm and the torso of said batter, said vest having a resilient pad having a contoured top edge to fit below the batter's trailing arm and an adjustable harness attached to said pad, said pad providing a resilient deterrent to downward movement of said trailing arm towards said torso, comprising the steps of:

placing said vest on said batter;

adjusting said harness to fit said contoured top edge below said batter's trailing arm and such that said batter's trailing arm is deterred from dropping toward said batter's torso; and having the batter swing a baseball bat using said vest.

* * * * *